US009567548B2

(12) United States Patent
Yamazaki

(10) Patent No.: US 9,567,548 B2
(45) Date of Patent: Feb. 14, 2017

(54) GREASE COMPOSITION

(71) Applicant: KYODO YUSHI CO., LTD., Fujisawa-shi, Kanagawa (JP)

(72) Inventor: Satoshi Yamazaki, Kamakura (JP)

(73) Assignee: KYODO YUSHI CO., LTD., Kanagawa (JP)

( * ) Notice: Subject to any disclaimer, the term of this patent is extended or adjusted under 35 U.S.C. 154(b) by 0 days.

(21) Appl. No.: 14/430,396

(22) PCT Filed: Oct. 4, 2013

(86) PCT No.: PCT/JP2013/077138

§ 371 (c)(1),
(2) Date: Mar. 23, 2015

(87) PCT Pub. No.: WO2014/054797

PCT Pub. Date: Apr. 10, 2014

(65) Prior Publication Data

US 2015/0247105 A1 Sep. 3, 2015

(30) Foreign Application Priority Data

Oct. 5, 2012 (JP) ..... 2012-223388

(51) Int. Cl.

| | |
|---|---|
| ***C10M 141/10*** | (2006.01) |
| ***C10M 173/02*** | (2006.01) |
| ***B65H 3/18*** | (2006.01) |
| ***C10M 169/06*** | (2006.01) |
| ***C10M 141/08*** | (2006.01) |
| ***C10M 169/02*** | (2006.01) |

(52) U.S. Cl.

CPC ..... *C10M 169/06* (2013.01); *C10M 141/08* (2013.01); *C10M 169/02* (2013.01); *C10M 2203/1006* (2013.01); *C10M 2205/14* (2013.01); *C10M 2205/18* (2013.01); *C10M 2207/40* (2013.01); *C10M 2215/1026* (2013.01); *C10M 2219/044* (2013.01); *C10M 2219/068* (2013.01); *C10M 2227/066* (2013.01); *C10N 2230/06* (2013.01); *C10N 2230/76* (2013.01); *C10N 2240/04* (2013.01); *C10N 2250/10* (2013.01)

(58) Field of Classification Search

CPC ..... C10M 2219/068; C10M 2215/28; C10M 2201/041; C10M 2205/18

USPC ..... 508/365, 528, 120, 450

See application file for complete search history.

(56) References Cited

U.S. PATENT DOCUMENTS

| | | | | |
|---|---|---|---|---|
| 5,607,906 | A | 3/1997 | Okaniwa et al. | |
| 2006/0068996 | A1* | 3/2006 | Kuwabara et al. | 508/167 |
| 2008/0176776 | A1* | 7/2008 | E. et al. | 508/376 |

FOREIGN PATENT DOCUMENTS

| | | | |
|---|---|---|---|
| JP | 9-194871 | A | 7/1997 |
| JP | 9-324189 | A | 12/1997 |
| JP | 2006-096949 | A | 4/2006 |
| JP | 2011-037950 | A | 2/2011 |

OTHER PUBLICATIONS

International Search Report (PCT/ISA/210) mailed on Dec. 17, 2013, by the Japanese Patent Office as the International Searching Authority for International Application No. PCT/JP2013/077138.

Written Opinion (PCT/ISA/237) mailed on Dec. 17, 2013, by the Japanese Patent Office as the International Searching Authority for International Application No. PCT/JP2013/077138.

* cited by examiner

*Primary Examiner* — Vishal Vasisth

(74) *Attorney, Agent, or Firm* — Buchanan, Ingersoll & Rooney PC

(57) ABSTRACT

A grease composition for constant velocity joints which comprises the following components: (a) a base oil, (b) a thickener, (c) a montan wax, (d) a zinc sulfonate, and (e) a sulfurized molybdenum dialkyldithiocarbamate.

5 Claims, No Drawings

GREASE COMPOSITION

This application is a 371 of PCT/JP2013/077138, filed Oct. 4, 2013.

TECHNICAL FIELD

The present invention relates to a grease composition for a constant velocity joint (CVJ). Due to generation of an extremely high surface pressure, some portions of the constant velocity joint to be lubricated are subjected to complicated rolling/sliding motions, which often cause abnormal vibrations. The invention relates to a grease composition for the constant velocity joint, capable of efficiently lubricating the constant velocity joint and effectively reducing the coefficient of friction to prevent the vibrations from occurring. In addition, the invention relates to a grease composition that makes it possible to improve the durability of the constant velocity joint by reducing the wear of the portions to be lubricated.

BACKGROUND ART

In the recent automobile industry, the number of front-engine front-drive (FF) vehicles is rapidly increasing for realizing environmentally friendly vehicles ($CO_2$ emission reduction) by the weight reduction and ensuring the living space. With the rise of the FF vehicles, the constant velocity joint (CVJ) essential for the FF vehicles is widely used. The constant velocity joint, especially a plunging type constant velocity joint, in particular, a tripod constant velocity joint (TJ), a double offset constant velocity joint (DOJ) or the like performs complicated rolling/sliding motions at a certain angle during the driving cycle. This causes a sliding resistance in the axial direction. The sliding resistance will lead to vibrations during the idling mode and swaying of the vehicle at the time of starting and accelerating, and become a source of vibrations to generate the beat noise or the booming noise in the interior of a vehicle at particular speeds. There are various improvements in the structure of the constant velocity joint to solve the above-mentioned problems. However, those improvements are restricted in light of the space and the weight of the joint and also from the viewpoint of cost. Therefore, a grease composition excellent in the performance of reducing vibrations is demanded.

In response to such a demand, there is proposed a grease composition for the constant velocity joint, comprising a base oil, a urea thickener, molybdenum disulfide, and at least one selected from the group consisting of calcium salts of oxidized wax, calcium salts of petroleum sulfonic acid, calcium salts of alkyl aromatic sulfonic acid, calcium salts of salicylate, calcium salts of phenate, overbased calcium salts of oxidized wax, overbased calcium salts of petroleum sulfonic acid, overbased calcium salts of alkyl aromatic sulfonic acid, overbased calcium salts of salicylate and overbased calcium salts of phenate (JP Hei 9-194871 A). Another grease composition for the constant velocity joint is proposed where a metal-free sulfur-phosphorus extreme-pressure agent and molybdenum dithiocarbamate are added to the components of the above-mentioned grease composition (JP Hei 9-324189 A). Further, there is proposed a composition for the constant velocity joint, comprising a base oil, diurea thickener, molybdenum disulfide, molybdenum dialkyl dithiocarbamate sulfide, a calcium salt of petroleum sulfonic acid, a sulfur-phosphorus extreme-pressure agent, and a vegetable fat or oil (JP 2006-96949 A). To meet the recent request for more quietness, there is proposed a grease composition for the constant velocity joint, comprising a base oil, diurea thickener, molybdenum dialkyl dithiocarbamate sulfide, zinc sulfonate, a sulfur-phosphorus extreme-pressure agent, and a vegetable fat or oil (JP 2011-37950 A).

In line with the increased engine power and the higher performance of vehicles, more comfortable ride and more quietness are requested, so that the demands for decrease in the vibration resulting from the constant velocity joint and decrease in the vibrations caused with time are increasing. However, the current grease compositions for the constant velocity joint have the problem that the demand for reduction of the vibrations caused with time cannot be satisfied. The grease composition for the constant velocity joint is required to meet the demand for keeping the quietness.

SUMMARY OF INVENTION

The invention aimed to solve the above-mentioned problems. Namely, an object of the invention is to provide a grease composition capable of efficiently lubricating the constant velocity joint, effectively reducing the coefficient of friction to prevent occurrence of the vibrations, and reducing the wear of the portions to be lubricated to prevent the flaking that would be caused by metal fatigue, thereby improving the durability of the constant velocity joint.

The inventors of the invention have extensively developed and researched into a grease composition that can reduce the friction with the constant velocity joint to prevent the vibrations. The inventors have also made evaluations of the grease performance under the lubricating conditions subject to easily causing vibrations, using an SRV tester known as a high-frequency linear-oscillation test machine. As a result, a special relationship was found between the vibrations resulting from the constant velocity joint and the coefficient of friction determined by the SRV tester under the particular oscillation conditions. Further, as the result of the intensive studies, the inventors have discovered that a grease composition comprising the components shown below can notably prevent the occurrence of vibrations, and at the same time, extend the life of durability of the constant velocity joint. The invention has thus been attained.

The invention has been accomplished based on the above-mentioned discovery, and provides a grease composition shown below.

1. A grease composition comprising the following components (a) to (e):

(a) a base oil, (b) a thickener, (c) montan wax, (d) zinc sulfonate, and (e) molybdenum dialkyl dithiocarbamate sulfide.

2. The grease composition described in the above-mentioned item 1, wherein the thickener of the component (b) is a diurea thickener represented by the following formula:

$$R^3\text{—NH—CO—NH—}C_6H_4\text{-}p\text{-}CH_2\text{—}C_6H_4\text{-}p\text{-NH—CO—NH—}R^4$$

wherein $R^3$ and $R^4$ which may be the same or different from each other, each independently represent a group selected from the group consisting of alkyl groups having 8 to 20 carbon atoms, aryl groups having 6 to 12 carbon atoms, and cycloalkyl groups having 6 to 12 carbon atoms.

3. The grease composition described in the above-mentioned item 1 or 2, further comprising (f) a fat or oil containing at least 70 mass % of a $C_{18}$-fatty acid glyceride.

4. The grease composition described in any one of the above-mentioned items 1 to 3, further comprising (g) a sulfur-phosphorus extreme-pressure agent.

5. The grease composition described in any one of the above-mentioned items 1 to 4, wherein:

(a) the base oil is contained in an amount of 37 to 97.25 mass %, (b) the thickener is contained in an amount of 1 to 25 mass %, (c) the montan wax is contained in an amount of 0.1 to 5 mass %, (d) the zinc sulfonate is contained in an amount of 0.1 to 15 mass %, (e) the molybdenum dialkyl dithiocarbamate sulfide is contained in an amount of 0.1 to 10 mass %, (f) the fat or oil containing at least 70 mass % of the $C_{18}$-fatty acid glyceride is contained in an amount of 0.1 to 5 mass %, and (g) the sulfur-phosphorus extreme-pressure agent is contained in an amount of 0.05 to 3 mass %, based on the total amount of the grease composition.

6. The grease composition described in any one of the above-mentioned items 1 to 5, wherein the grease composition is intended for a constant velocity joint.

7. The grease composition described in the above-mentioned item 6, wherein the constant velocity joint is a sliding type constant velocity joint.

The grease composition of the invention can efficiently lubricate the constant velocity joint and effectively reduce the coefficient of friction to exhibit a noticeable effect of preventing the vibrations. In addition, the grease composition of the invention can prevent the wear of the lubricated portion, thereby improving the life of durability of the constant velocity joint.

DESCRIPTION OF EMBODIMENTS

The grease composition of the invention will now be explained in detail.

The grease composition according to the invention comprises the following components (a) to (e):

(a) a base oil, (b) a thickener, (c) montan wax, (d) zinc sulfonate, and (e) molybdenum dialkyl dithiocarbamate sulfide.

As the base oil of the component (a), generally used lubricating oils such as mineral oils, ether type synthetic oils, ester type synthetic oils, hydrocarbon synthetic oils and the like, or mixtures of those oils can be used, but not limited thereto. In consideration of the cost, use of the mineral oil is preferable, and in particular, a mixture comprising the mineral oil predominantly and the synthetic oil is more preferably used as the base oil.

The above-mentioned base oil may preferably have a kinematic viscosity of 5 to 30 $mm^2/s$ at 100° C., more preferably 7 to 20 $mm^2/s$. When the kinematic viscosity is less than 5 $mm^2/s$, it will be difficult to form an oil film in the constant velocity joint (CVJ), so that the durability tends to be poor under the high-speed rotation. When the kinematic viscosity exceeds 30 $mm^2/s$, the durability under the high-speed rotation may probably decrease because of heat generated in the CVJ.

The content of the above-mentioned base oil may preferably be 37 to 97.25 mass %, more preferably 70 to 90 mass %.

As the component (b), any thickeners known as those for grease can be used. Examples of those thickeners include soap type thickeners such as lithium soap, calcium soap, sodium soap and the like; complex soap thickeners such as lithium complex soap, calcium complex soap, aluminum complex soap, calcium sulfonate complex soap and the like; urea type thickeners such as diurea, tetraurea and the like; organic thickeners such as polytetrafluoroethylene (PTFE), MCA, carbon black and the like; and inorganic thickeners such as organoclay, fine silica and the like. Preferably, a diurea thickener represented by the following formula may be used:

$$R^3—NH—CO—NH—C_6H_4\text{-}p\text{-}CH_2—C_6H_4\text{-}p\text{-}NH—CO—NH—R^4$$

wherein $R^3$ and $R^4$, which may be the same or different from each other, each independently represent one group selected from the group consisting of alkyl groups having 8 to 20 carbon atoms, preferably 8 to 18 carbon atoms, aryl groups having 6 to 12 carbon atoms, preferably 6 to 7 carbon atoms, and cycloalkyl groups having 6 to 12 carbon atoms, preferably 6 to 7 carbon atoms.

The above-mentioned diurea thickener can be obtained by reacting a predetermined diisocyanate with a predetermined monoamine. A preferable specific example of the diisocyanate is diphenylmethane-4,4'-diisocyanate. Examples of the monoamine include aliphatic amine compounds, aromatic amine compounds, alicyclic amine compounds and the mixtures thereof. Specific examples of the aliphatic amine compounds include alkylamines having 8 to 18 carbon atoms, such as octylamine, dodecylamine, hexadecylamine, octadecylamine, and oleylamine. Specific examples of the aromatic amine compounds include aniline and p-toluidine. Specific examples of the alicyclic amine compounds include cyclohexylamine. The method of reacting the diisocyanate with the monoamine as mentioned above is not particularly limited, and any conventional methods can be used for the preparation.

In particular, as the component (b), the diurea thickener obtainable from octylamine, octadecylamine, cyclohexylamine, or the mixture thereof is preferred.

The content of the above-mentioned thickener may preferably be 1 to 25 mass %, more preferably 5 to 15 mass %. When the content is less than 1 mass %, the resultant product may not be prepared into a grease form because of the insufficient thickening effect. When the content exceeds 25 mass %, the resultant composition may become too hard to obtain the desired effect. In light of the above, the thickener may preferably be contained within the above-mentioned range.

The montan wax of the component (c), which is made from lignite is a general term of the mineral wax based on montanic acid obtainable from the lignite through purification and oxidization. The montan wax is applied to the electrical insulating agent, coating agent, carbon paper, releasant and the like. Examples of the commercially available montan wax include acid waxes such as Licowax U, Licowax S and the like, ester waxes such as Licowax E, Licowax WE40 and the like, and partly saponified ester waxes such as Licowax OP, Licowax O and the like, which are all made by Clariant Ltd.

The content of the above-mentioned montan wax may preferably be 0.1 to 15 mass %, more preferably 0.1 to 5 mass %, and most preferably 0.3 to 5 mass %. When the content is less than 0.1 mass %, the effect of improving the life of durability may not be obtained. On the other hand, when the montan wax is contained in an amount of more than 15 mass %, even in an amount of more than 5 mass %, any increased effect may not be expected. In light of the above, the montan wax may be contained within the above-mentioned range.

The above-mentioned component (d), i.e., zinc sulfonate is obtained by sulfonating the aromatic hydrocarbon moiety contained in a lubricating oil distillate that is known as a metal detergent and dispersant or a rust inhibitor used for the lubricating oil such as engine oil or the like. The total base number of the employed zinc sulfonate may preferably be no more than 50 mgKOH/g, more preferably no more than 40 mgKOH/g. By way of example, zinc salt of dinonylnaphthalenesulfonic acid having a total base number of no more than 50 mgKOH/g can be used preferably.

The content of the above-mentioned zinc sulfonate may preferably be 0.1 to 15 mass %, more preferably 1 to 10 mass %. When the content is less than 0.1 mass %, the desired effect may not be obtained. On the other hand, when the content exceeds 15 mass %, any increase of the effect may not be expected. In light of the above, the zinc sulfonate may be contained within the above-mentioned range.

The above-mentioned component (e), i.e., molybdenum dialkyl dithiocarbamate sulfide may preferably be molybdenum dialkyl dithiocarbamate sulfide represented by the following formula:

$$(R^1R^2N—CS—S)_2—Mo_2O_mS_n$$

wherein $R^1$ and $R^2$ are each independently an alkyl group having 1 to 24 carbon atoms, preferably 2 to 18 carbon atoms; and m is 0 to 3 and n is 4 to 1, provided that m+n=4.

The content of the above-mentioned molybdenum dialkyl dithiocarbamate sulfide may preferably be 0.1 to 15 mass %, more preferably 0.1 to 10 mass %, and most preferably 0.5 to 5 mass %. When the content is less than 0.1 mass %, the desired effect may not be obtained. On the other hand, when the molybdenum dialkyl dithiocarbamate sulfide is contained in an amount of more than 15 mass %, particularly even in an amount of more than 5 mass %, any increase of the effect may not be expected. In light of the above, the molybdenum dialkyl dithiocarbamate sulfide may be contained within the above-mentioned range.

Preferably, the grease composition of the invention may further comprise a fat or oil containing at least 70 mass % of a $C_{18}$-fatty acid glyceride as the component (f). The fat or oil containing at least 70 mass % of a $C_{18}$-fatty acid glyceride tends to adsorb on the metal surface, thereby preventing the metal surfaces from coming in contact with each other and therefore reducing the friction. Examples of the fat or oil containing at least 70 mass % of a $C_{18}$-fatty acid glyceride include castor oil (the content of $C_{18}$-fatty acid glyceride: 98.5 mass %); olive oil (the content of $C_{18}$-fatty acid glyceride: 83.5 mass %); rapeseed oil (the content of $C_{18}$-fatty acid glyceride: 75.6 mass %); linseed oil (the content of $C_{18}$-fatty acid glyceride: 89.4 mass %); and the like. In particular, the castor oil is preferred.

The content of the above-mentioned fat or oil may preferably be 0.1 to 5 mass %, more preferably 0.5 to 5 mass %. When the content is less than 0.1 mass %, the desired effect may not be obtained. On the other hand, when the above-mentioned fat or oil is contained in an amount of more than 5 mass %, any increase effect may not be expected. In light of the above, the fat or oil may be contained within the above-mentioned range.

Preferably, the grease composition of the invention may further comprise a sulfur-phosphorus extreme-pressure agent as the component (g). The sulfur-phosphorus extreme-pressure agent may preferably comprise 15 to 35 mass % of the sulfur component and 0.5 to 3 mass % of the phosphorus component. Proper adjustment of the ratio of the sulfur component to the phosphorus component can lead to demonstration of the excellent performance of wear prevention and seizing prevention. With more ratio of the sulfur component, the joint may readily be corroded. With more ratio of the phosphorus component, it may be difficult to obtain the effect of preventing wear of the joint. When the contents of both components are less than the above-mentioned ranges, the effect of preventing wear and seizing may not be sufficiently exhibited.

The content of the above-mentioned sulfur-phosphorus extreme-pressure agent may preferably be 0.05 to 3 mass %, more preferably 0.1 to 1 mass %. When the content is less than 0.05 mass %, the effect of wear resistance may not be obtained. With the content of more than 1 mass %, any improvement in the effect may not be expected. In light of the above, the sulfur-phosphorus extreme-pressure agent may be contained within the above-mentioned range.

The grease composition of the invention may further comprise an oiliness improver, antioxidant, rust inhibitor and polymer additives commonly used in a variety of lubricating oil and grease compositions in addition to the above-mentioned components (a) to (g). Furthermore, it is possible to add other extreme-pressure agents, friction modifiers, antiwear agents, solid lubricants and the like. When added, those optional additives may preferably be contained in an amount of 0.1 to 10 mass % based on the total mass of the grease composition.

The consistency of the grease composition according to the invention may preferably be in the range of 220 to 385, more preferably 265 to 340.

The grease composition of the invention can most effectively demonstrate the performance when used for the constant velocity joint, preferably the sliding type constant velocity joint. Needless to say, however, the grease composition of the invention can be used for lubricating other lubrication portions than the constant velocity joint.

The invention will now be explained more specifically by referring to the following examples, which are not intended to limiting the scope of the invention.

EXAMPLES

Examples 1 to 6 and Comparative Examples 1 to 20

A mixture of 455 g of a base oil and 43.6 g of diphenylmethane-4,4'-diisocyanate placed into a container was heated to 70 to 80° C. Into another container, 455 g of the base oil, 27.6 g of cyclohexylamine and 18.8 g of stearylamine were placed and heated to 70 to 80° C., and the resultant mixture was then added to the first mixture to cause a reaction for 30 minutes with vigorously stirring. The temperature of the mixture thus obtained was increased to 160° C. with stirring. Then, the mixture was allowed to stand at room temperature, thereby obtaining a base grease of urea type. To the base grease thus obtained, the additives were added to prepare a composition as shown in Table 1. With the base oil being appropriately added, the mixture was blended with a three roll mill to have a consistency of a grade No. 1.

A mineral oil having the following characteristics was used as the base oil for grease.

| | | |
|---|---|---|
| Viscosity | 40° C. | 102 $mm^2/s$ |
| | 100° C. | 11.2 $mm^2/s$ |
| Viscosity index | 88 | |

Table 1 shows the compositions of Examples 1 to 6; and Tables 2 to 5 show those of Comparative Examples 1 to 20.

A grease composition of Comparative Example 20 is a commercially available urea type grease containing MoDTC (made by Kyodo Yushi Co., Ltd.).

The components shown in the Tables are as follows, and the numerals indicated in the Tables are based on the unit of mass %.

MoDTC: molybdenum dialkyl dithiocarbamate sulfide ($((C_4H_9)_2N—CS—S)_2—Mo_2O_2S_2$) Zinc sulfonate: zinc dinonylnaphthalenesulfonate (with a total base number of 2.8 mgKOH/g)

S-P extreme-pressure agent: containing the sulfur content of 31.5 mass % and the phosphorus content of 1.7 mass %.

Fat or oil A: Castor oil (containing $C_{18}$-fatty acid glyceride of 98.5 mass %)

Fat or oil B: Rapeseed oil (containing $C_{18}$-fatty acid glyceride of 75.6 mass %)

Fat or oil C: Palm oil (containing $C_{18}$-fatty acid glyceride of 55.1 mass %)

Wax A: Montan wax

Wax B: Fatty acid amide wax

Wax C: Polyethylene wax

The physical properties of the grease compositions for constant velocity joint thus prepared were evaluated by the methods shown below.

<Consistency>

The consistency was determined in accordance with the JIS K2220.7.

<SRV Test for Determining Friction and Wear Properties>

Test Pieces

Ball: diameter of 17.5 mm (SUJ2)

Plate: 24 mm dia.×7.85 mm (SUJ2)

Test Conditions

Load: 200 N

Frequency: 50 Hz

Stroke amplitude: 0.8 mm

Duration: 30 minutes

Temperature: 40° C.

Evaluation Items

The coefficient of friction (g) and the diameter of wear scar after the test.

<CVJ Test>

Axial Force Test

An axial force test was carried out by using an actual join under the following test conditions to determine the force applied to the joint.

Test Conditions:

Number of revolutions: 200 rpm

Torque: 700 Nm

Angle of joint: 15°

Running time: 2 min.

Type of joint: tripod constant velocity joint

Evaluation Items

The force applied to the joint was measured and evaluated as the increased or decreased ratio (%) based on that obtained when the commercially available grease was used.

Life of Durability Test

Test Conditions:

Number of revolutions: 200 rpm

Torque: 1000 Nm

Angle: 7°

Type of joint: tripod constant velocity joint

Criteria for judging: The time elapsed before the flaking occurred on the portions (outer ring, trunnion, roller and needle) of the inboard joint.

○: at least 500 hours x: less than 500 hours

TABLE 1

| | | (Examples) | | | | | |
|---|---|---|---|---|---|---|---|
| | | 1 | 2 | 3 | 4 | 5 | 6 |
| Diurea base grease | | 94.0 | 93.5 | 93.0 | 93.0 | 92.5 | 92.5 |
| 1) MoDTC | | 2.0 | 2.0 | 2.0 | 2.0 | 2.0 | 2.0 |
| 2) Zinc sulfonate | | 3.0 | 3.0 | 3.0 | 3.0 | 3.0 | 3.0 |
| 3) Ca sulfonate | | — | — | — | — | — | — |
| 4) S-P extreme pressure agent | | — | 0.5 | — | — | 0.5 | 0.5 |
| 5) Fat or oil A | | — | — | 1.0 | — | 1.0 | — |
| 6) Fat or oil B | | — | — | — | 1.0 | — | 1.0 |
| 7) Fat or oil C | | — | — | — | — | — | — |
| 8) Wax A | | 1.0 | 1.0 | 1.0 | 1.0 | 1.0 | 1.0 |
| 9) Wax B | | — | — | — | — | — | — |
| 10) Wax C | | — | — | — | — | — | — |
| Consistency (60 W) | | 320 | 330 | 315 | 325 | 320 | 325 |
| SRV Test | Coefficient of friction | 0.038 | 0.037 | 0.035 | 0.036 | 0.035 | 0.035 |
| | Diameter of wear scar on ball (mm) | 0.38 | 0.37 | 0.36 | 0.37 | 0.38 | 0.37 |

TABLE 1-continued

| | | (Examples) | | | | | |
|---|---|---|---|---|---|---|---|
| | | 1 | 2 | 3 | 4 | 5 | 6 |
| CVJ Test | Decreased ratio of force applied | −22 | −27 | −24 | −26 | −27 | −25 |
| | Life of durability | ○ | ○ | ○ | ○ | ○ | ○ |

TABLE 2

| | | (Comparative Examples) | | | | |
|---|---|---|---|---|---|---|
| | | 1 | 2 | 3 | 4 | 5 |
| Diurea base grease | | 96.0 | 97.0 | 95.0 | 95.5 | 96.5 |
| 1) MoDTC | | — | 2.0 | 2.0 | — | 2.0 |
| 2) Zinc sulfonate | | 3.0 | — | 3.0 | 3.0 | — |
| 3) Ca sulfonate | | — | — | — | — | — |
| 4) S-P extreme pressure agent | | — | — | — | 0.5 | 0.5 |
| 5) Fat or oil A | | — | — | — | — | — |
| 6) Fat or oil B | | — | — | — | — | — |
| 7) Fat or oil C | | — | — | — | — | — |
| 8) Wax A | | 1.0 | 1.0 | — | 1.0 | 1.0 |
| 9) Wax B | | — | — | — | — | — |
| 10) Wax C | | — | — | — | — | — |
| Consistency (60 W) | | 325 | 320 | 330 | 315 | 315 |
| SRV Test | Coefficient of friction | 0.080 | 0.082 | 0.075 | 0.076 | 0.081 |
| | Diameter of wear scar on ball (mm) | 0.54 | 0.56 | 0.55 | 0.54 | 0.56 |
| CVJ Test | Decreased ratio of force applied | +1 | −1 | −3 | +1 | −1 |
| | Life of durability | x | x | x | x | x |

TABLE 3

| | | (Comparative Examples) | | | | |
|---|---|---|---|---|---|---|
| | | 6 | 7 | 8 | 9 | 10 |
| Diurea base grease | | 94.5 | 94.5 | 95.5 | 93.5 | 95.0 |
| 1) MoDTC | | 2.0 | — | 2.0 | 2.0 | — |
| 2) Zinc sulfonate | | 3.0 | 3.0 | — | 3.0 | 3.0 |
| 3) Ca sulfonate | | — | — | — | — | — |
| 4) S-P extreme pressure agent | | 0.5 | 0.5 | 0.5 | 0.5 | — |
| 5) Fat or oil A | | — | 1.0 | 1.0 | 1.0 | — |
| 6) Fat or oil B | | — | — | — | — | 1.0 |
| 7) Fat or oil C | | — | — | — | — | — |
| 8) Wax A | | — | 1.0 | 1.0 | — | 1.0 |
| 9) Wax B | | — | — | — | — | — |
| 10) Wax C | | — | — | — | — | — |
| Consistency (60 W) | | 330 | 325 | 325 | 320 | 330 |
| SRV Test | Coefficient of friction | 0.077 | 0.082 | 0.083 | 0.085 | 0.084 |
| | Diameter of wear scar on ball (mm) | 0.56 | 0.57 | 0.56 | 0.57 | 0.55 |
| CVJ Test | Decreased ratio of force applied | −4 | +4 | −3 | +2 | −2 |
| | Life of durability | x | x | x | x | x |

TABLE 4

| | | (Comparative Examples) | | | | |
|---|---|---|---|---|---|---|
| | | 11 | 12 | 13 | 14 | 15 |
| Diurea base grease | | 96.0 | 94.0 | 94.5 | 95.5 | 93.5 |
| 1) MoDTC | | 2.0 | 2.0 | — | 2.0 | 2.0 |
| 2) Zinc sulfonate | | — | 3.0 | 3.0 | — | 3.0 |
| 3) Ca sulfonate | | — | — | — | — | — |
| 4) S-P extreme pressure agent | | — | — | 0.5 | 0.5 | 0.5 |
| 5) Fat or oil A | | — | — | — | — | — |
| 6) Fat or oil B | | 1.0 | 1.0 | 1.0 | 1.0 | 1.0 |
| 7) Fat or oil C | | — | — | — | — | — |
| 8) Wax A | | 1.0 | — | 1.0 | 1.0 | — |
| 9) Wax B | | — | — | — | — | — |
| 10) Wax C | | — | — | — | — | — |
| Consistency (60 W) | | 325 | 325 | 330 | 325 | 315 |
| SRV Test | Coefficient of friction | 0.083 | 0.079 | 0.084 | 0.079 | 0.082 |
| | Diameter of wear scar on ball (mm) | 0.56 | 0.56 | 0.55 | 0.56 | 0.55 |
| CVJ Test | Decreased ratio of force applied | −1 | −1 | −2 | −1 | +3 |
| | Life of durability | x | x | x | x | x |

TABLE 5

| | | (Comparative Examples) | | | | |
|---|---|---|---|---|---|---|
| | | 16 | 17 | 18 | 19 | 20 |
| Diurea base grease | | 92.5 | 92.5 | 92.5 | 92.5 | Commercially available grease containing MoDTC |
| 1) MoDTC | | 2.0 | 2.0 | 2.0 | 2.0 | |
| 2) Zinc sulfonate | | 3.0 | 3.0 | 3.0 | 3.0 | |
| 3) Ca sulfonate | | — | — | — | — | |
| 4) S-P extreme pressure agent | | 0.5 | 0.5 | 0.5 | 0.5 | |
| 5) Fat or oil A | | 1.0 | 1.0 | — | — | |
| 6) Fat or oil B | | — | — | 1.0 | 1.0 | |
| 7) Fat or oil C | | — | — | — | — | |
| 8) Wax A | | — | — | — | — | |
| 9) Wax B | | 1.0 | — | 1.0 | — | |
| 10) Wax C | | — | 1.0 | — | 1.0 | |
| Consistency (60 W) | | 320 | 325 | 325 | 315 | 325 |
| SRV Test | Coefficient of friction | 0.036 | 0.038 | 0.037 | 0.035 | 0.088 |
| | Diameter of wear scar on ball (mm) | 0.54 | 0.56 | 0.59 | 0.58 | 0.60 |
| CVJ Test | Decreased ratio of force applied | −24 | −26 | −25 | −23 | +5 |
| | Life of durability | x | x | x | x | x |

Effects of the Tests:

The grease composition of the invention comprises (a) a base oil, (b) a thickener, (c) montan wax, (d) zinc sulfonate, and (e) molybdenum dialkyl dithiocarbamate sulfide. As can be seen from the results in Examples and Comparative Examples, the SRV test results show the lower coefficient of friction and better wear resistance in the grease compositions of the invention; and the CVJ test results show that the vibrations can be prevented from occurring, thereby drastically improving the life of durability.

The invention claimed is:

1. A grease composition for a constant velocity joint, comprising:

(a) a base oil, (b) a thickener, (c) montan wax wherein the montan wax (c) is contained in an amount of 0.1 to 15 mass % based on the total amount of the grease composition, (d) zinc sulfonate which is zinc salt of dinonylnaphthalenesulfonic acid, and (e) molybdenum dialkyl dithiocarbamate sulfide wherein the molybdenum dialkyl dithiocarbamate sulfide (e) is contained in an amount of 0.1 to 15 mass % based on the total amount of the grease composition, wherein the zinc sulfonate (d) is contained in an amount of 1 to 10 mass % and a total base number of the zinc sulfonate (d) is no more than 50 mgKOH/g.

2. The grease composition of claim 1, wherein the thickener of the component (b) is a diurea thickener represented by the following formula:

$$R^3—NH—CO—NH—C_6H_4\text{-}p\text{-}CH_2—C_6H_4\text{-}p\text{-}NH—CO—NH—R^4$$

wherein $R^3$ and $R^4$, which may be the same or different from each other, each independently represent a group selected from the group consisting of alkyl groups having 8 to 20 carbon atoms, aryl groups having 6 to 12 carbon atoms, and cycloalkyl groups having 6 to 12 carbon atoms.

3. The grease composition of claim 1, further comprising (f) a fat or oil containing at least 70 mass % of a $C_{18}$-fatty acid glyceride.

4. The grease composition of claim 1, further comprising (g) a sulfur-phosphorus extreme-pressure agent.

5. The grease composition of claim 1, wherein the constant velocity joint is a sliding type constant velocity joint.

* * * * *